US007104211B2

(12) United States Patent
Widlacki

(10) Patent No.: US 7,104,211 B2
(45) Date of Patent: Sep. 12, 2006

(54) WATERCRAFT STABILIZING DEVICE

(76) Inventor: Don Felix Widlacki, 711 73rd St., Newport News, VA (US) 23605

( * ) Notice: Subject to any disclaimer, the term of this patent is extended or adjusted under 35 U.S.C. 154(b) by 0 days.

(21) Appl. No.: 11/219,198

(22) Filed: Sep. 2, 2005

(65) Prior Publication Data

US 2006/0000399 A1 Jan. 5, 2006

Related U.S. Application Data

(63) Continuation-in-part of application No. 10/761,561, filed on Jan. 20, 2004, now abandoned.

(60) Provisional application No. 60/442,979, filed on Jan. 28, 2003.

(51) Int. Cl.
*B63B 3/38* (2006.01)

(52) U.S. Cl. ..... 114/140; 114/126

(58) Field of Classification Search ..... 114/126, 114/162, 165, 140; 440/14, 15
See application file for complete search history.

(56) References Cited

U.S. PATENT DOCUMENTS 3,108,565 A * 10/1963 Cain ..... 416/74
4,327,657 A * 5/1982 Knoos ..... 114/144 C

* cited by examiner

*Primary Examiner*—Ed Swinehart
(74) *Attorney, Agent, or Firm*—Goldizen & Associates; Bradley D. Goldizen

(57) ABSTRACT

A device for stabilizing boats and other watercraft that is generally blade-shaped and attaches to the body or hull of the boat. The stabilizing device projects generally outwardly and downwardly from the boat and is pivotally connected along the vertical axis at the attachment point to the watercraft. The device dramatically improves the stability of the boat and resists stops unwanted drift either from a stationary position or from a desired heading.

18 Claims, 5 Drawing Sheets

WATERCRAFT STABILIZING DEVICE

This application claims the benefit of U.S. Provisional Patent Application No. 60/442,979, filed Jan. 28, 2003 and is a continuation-in-part of Application Ser. No. 10/761,561, filed Jan. 20, 2004, now abandoned.

This application did not receive any federal research and development funding.

BACKGROUND OF THE INVENTION

The present invention relates in general to a stabilizing device for watercraft, and more particularly to watercraft of the type used for water sports such as fishing. Even more particularly this invention relates to a stabilizing device that is attachable to a watercraft in such a manner as to prevent drifting or moving off course as a result of natural or unnatural forces, particularly the effects of currents and wind upon a watercraft that is either stationary or moving on a desired heading.

When stationary in or on the surface of a body of water, most water-borne vehicles provide large surface areas along the longitudinal axis that makes the vehicle susceptible to the effects of forces such as water currents and wind, among other things. Such forces can cause the vehicle to drift either away from the desired stationary position or off of the desired course heading. This creates a need for constant vigilance and re-positioning of adjustments to maintain the desired position and/or heading.

A common solution for boaters wishing to remain in a stationary position is to allow the engine to idle and make use of a small trolling motor to achieve the same effect, but must maintain constant maneuvering of the motor. Either solution is not an effective answer to the problem for several reasons. First, it requires the constant vigilance and attention of the boater, often at a time when they are focusing on the task at hand, such as fishing. It distracts them, and may require sacrificing a fish catch merely to adjust the boat's position. Secondly, it wastes either gas in an outboard engine or battery power in a trolling motor. Third, it creates noise and water turbulence that could negatively impact fishing results. Finally, it is not an efficient or effective way to counter forces that are directed at an angle to the longitudinal axis of the boat.

The same types of adjustments are often necessary to maintain a desired course heading in an underway boat. The need for such constant course corrections wastes time and fuel. The present invention is a simple and cost-effective solution to the above problems.

SUMMARY OF THE INVENTION

The present invention provides a pivoting boat stabilizing device comprising a generally blade-shaped stabilizer with needed extra and additional downward angles for more surface area where needed most to totally control and stop drift and any motion and is attached to a boat that projects into the water in such a manner as to counter any movement of the boat at an angle to the longitudinal axis, such movements are the result of such things as wind, water currents, and other forces acting upon the boat from in or on the boat itself. This pivoting stabilizer with its extra downward angles provides resistance at an angle to the force countering the resultant unwanted motion of the boat. When the boat is stationary, the present invention operates to maintain the stationary position of the boat. When the boat is in motion, the device operates to keep the boat from drifting or moving off or away from any desired heading. This invention is designed in such a manner that it provides that complete additional lateral stability to a boat, while also being designed such that it a) is easy to install and remove from the boat when it is either in or out of the water; b) is light and durable; c) may withstand impacts on submerged objects without being damaged or breaking by pivoting relative to a trough or slot in the holder to allow the invention to pivot and either move freely away or causing it to distribute the impact throughout the boat in the event that the devices encounters the submerged object in either a forward, backward or sideways impact manner; d)is free to move in a vertical direction above and over submerged objects, and e) may be removed and used in an emergency by the operator or other persons as a spare paddle.

The present invention can be either build into the boat as a permanent part thereof, or as a system that is installed after the boat has been constructed. There are advantages to both, but the post-construction installation reduces cost and is easy to install, position for optimal stabilization, and remove. Further, an embodiment of the present invention allows for its quick removal to use as a spare paddle in the vent of an emergency.

All embodiments of the present invention, including additional extra downward angles and radiuses comprise a device that projects from the structure of the boat at an angle downward and/or outward such that part or all of the stabilizing surfaces of the device are in contact with the water at the same time.

A watercraft stabilizing device of the present invention comprises a support device including a mounting bracket having a flat base and holes therein for securing the support base to a hull of a watercraft via fastening means. The fastening means may comprise screws or the like. A downward angled trough is formed integral to the flat base and includes a bottom and two sides. Each side has a hole therein for receiving a pin. A blade includes an upper and lower edge and two planar sides. The lower edge has two or more downward angles arranged in a step-wise manner. A handle connects at one end to a blade and includes a hole near an end opposite the blade. The end near the hole is arranged in the trough and the hole is aligned with the holes in the sides of the trough. A pin passes through the holes in the sides of the trough and the hole in the handle.

The device itself comprises a blade portion, a shaft portion and a connecting means. The blade portion comprises generally a top edge, a bottom edge, proximal and distal ends, and two vertical surfaces. The blade portion is located at the end of the device furthest from the boat, and is attached to the connecting means through the shaft of the device. The device is attached to the boat or watercraft at the proximal end by the guide holder, which generally comprises a mounting surface and a holding mount slot with two holes, one on either side for a single quick-disconnect pin, corresponding to a single hole in the shaft of the device, that allows the shaft and blade to be pivotally secured into the slot portion of the connecting means. The mounting surface and holding mount slot are preferentially formed of one piece, and any strong rigid material may be used, although the same plastic material used to form the blade and shaft portion is preferred, as use of that material will reduce weight while simultaneously avoiding wear issues involved with having the shaft of the device move against a material of different hardness and wear characteristics. The slot portion of the connecting means corresponds to the narrowed portion of the shaft, and experimental use has shown that the slot portion, in length, should be no more than 10% of the overall length of the blade and shaft.

On the blade portion, the two vertical surfaces operate as the stabilizing surfaces, and are oriented generally perpendicular to the longitudinal axis of the boat or water craft. The blade portion also becomes narrower in width in the direction from the end proximal to the boat and running in the direction of the distal end. The blade may be made of any rigid or semi-rigid material, but is preferentially a semi-rigid material such as plastic or rubber. Experimental use has shown that the device is preferentially constructed in one piece of a flexible plastic in combination with the narrowing of the blade in horizontal cross-section towards the distal portion of the blade allows the device, when striking underwater obstacles, to flex and move around the obstacle rather than break or otherwise become damaged.

The blade portion further comprises a top and bottom edge, wherein the top and bottom edge widen vertically from the shaft portion while the bottom edge is at a greater angle and tangent to a second greater downward angle connecting to large radiuses on the ends of top and bottom edges, creating the vertical surface areas of the blade portion that provides the horizontal stability and control that is the purpose of the invention. The blade is also designed such that the blade portion becomes narrower along the longitudinal axis running from the end proximal to the boat towards the end distal so the boat operates more efficiently. Such narrowing does not reduce the surface area of the vertical sides of the device, but reduces the thickness of the device horizontally. Experimental use has shown that the blade should preferentially reduce in thickness in the horizontal plane to a thickness at the distal end that is approximately ⅓ the thickest at the point where the blade portion meets the shaft portion. For example, for a blade and shaft of overall length of 32 inches, a blade portion that is 66% to 70% of the overall length should be designed with a thickness in the horizontal plane of 0.750 inches at the blade end proximal to the shaft, and 0.250 inches at the blade end distal to the shaft.

The blade portion is further designed so that it will move upwardly and over submerged obstacles, rather than strike them and be damaged or broken, by designing the blade such that the bottom edge of the blade portion has a downward angle relative to the horizontal axis of the blade and shaft. Experimental use has also shown that an extra bottom edge with a second angle angled downward from the proximal end to the distal end for the full length of the blade portion provides a more effective lower edge for riding over obstructions and entanglements as the boat moves forward or backward. The top edge of the blade, however, after an initial angle extending from the shaft portion, is generally parallel relative to the horizontal plane of the blade. The combination of the downward angle of the lower portion of the blade relative to the horizontal axis of the blade allows the blade to ride over submerged obstacles while the top edge of the blade, by not having an unnecessary angle, maintains a maximum surface area for greater lateral stability.

Experimental use has shown that an effective blade design has a top edge that rises at an angle of 17 degrees from the horizontal axis of the shaft for ⅓ of the length of the blade portion, and thereafter runs parallel to the horizontal axis of the shaft. The bottom edge in such a blade design drops at an angle of 19 degrees relative to the horizontal axis of the shaft for ⅓ of the length of the blade portion, and thereafter at an angle of 12 degrees relative to the horizontal axis of the shaft. That combination of the 19 degree and 12 degree angle for the bottom edge of the blade maximizes the vertical surface area for greater lateral stability while creating an optimal downward angle on the bottom edge of the blade such that it may rise over submerged obstacles without impeding the forward progress of the boat or damaging and/or breaking the device.

The bottom edge of the blade further comprises a curving radius at the distal end. This curve, rather than a sharp angle such as 90 degrees, allows the blade portion to rise over submerged objects without harm while the boat is moving backwards rather than forwards.

In each case, the bottom edge is designed to maximize the effectiveness of the blade moving over submerged objects. While the boat and device are moving forward, the combination of the downward angles imparted by the connecting means and the bottom edge angles of the blade allow the blade to move around the pivot point in the connecting means vertically, thus avoiding damage; while the boat is moving backwards, the radius at the distal end of the bottom edge allows the device to rotate vertically around the pivot point at the connecting means to once again avoid damage to the device.

The blade portion may further comprise a mounting means on the top edge, generally a hold, that allows connection of a line from the top edge of the blade portion of the device to the boat. The line may be rope, chain, spring or rubberized material. The use of such a line allows the device to return to the maximum downward position in a controlled manner, and further allows the user to raise and lower the device with a minimal amount of effort.

The shaft portion ends in a narrowed portion with a pivot hole in the end proximal to the boat, and is intended to be held in place in the connecting means at the pivot point. For smaller boat application, the shaft portion is generally of a shape and size that allows the user to grasp the device by the shaft portion to attach and remove the device from the boat, in addition to using the device in an emergency situation as a spare paddle. Experimental use has shown that a shaft portion that is generally 25–40% of the overall length of the combined blade and shaft, and more particularly approximately 33⅓% of that overall length, optimizes the handling characteristics of the device while keeping the device at an acceptable overall downward angle into the water and having the most effective amount of blade surface area submerged to maximize the lateral stability imparted onto the boat by the device.

The downward angle of the device as a whole is imparted by the connecting means and the mounting surface on the stem of the boat to which the device is attached. Many smaller boats have a transom that is angled outward from the body of the boat so that the face of the transom is oriented generally down towards the surface of the water. This design feature of a boat will impart an inherent downward angle to the device.

In addition, the guide holding mount is constructed such that the shaft, when mounted in the holding mount at the pivot point, has a downward angle relative to the plane of the mounting surface by the holding mount being constructed in such a manner that the slot area into which the shaft portion of the device is mounted is angled outward and downward relative to the mounting surface of the connecting means. Although the downward angle of the holding mount slot may be at any angle downward relative to the plane of the mounting surface, experimental use has shown that an angle of between 10 and 20 degrees, and more particularly approximately 12 degrees, is preferred. The mounting surface of the connecting means is generally designed so that it may be bolted, screwed, or mounted by other means to the transom of a boat.

Further features and details of the invention will become clear to those skilled in the art to which this invention pertains upon reference to the following drawings and description.

DETAILED DESCRIPTION OF THE INVENTION

The following is the preferred embodiment or best mode for carrying out the invention. It should be noted that this invention is not limited by the discussion of the preferred embodiment and should only be defined by the appended claims.

Figure 1:
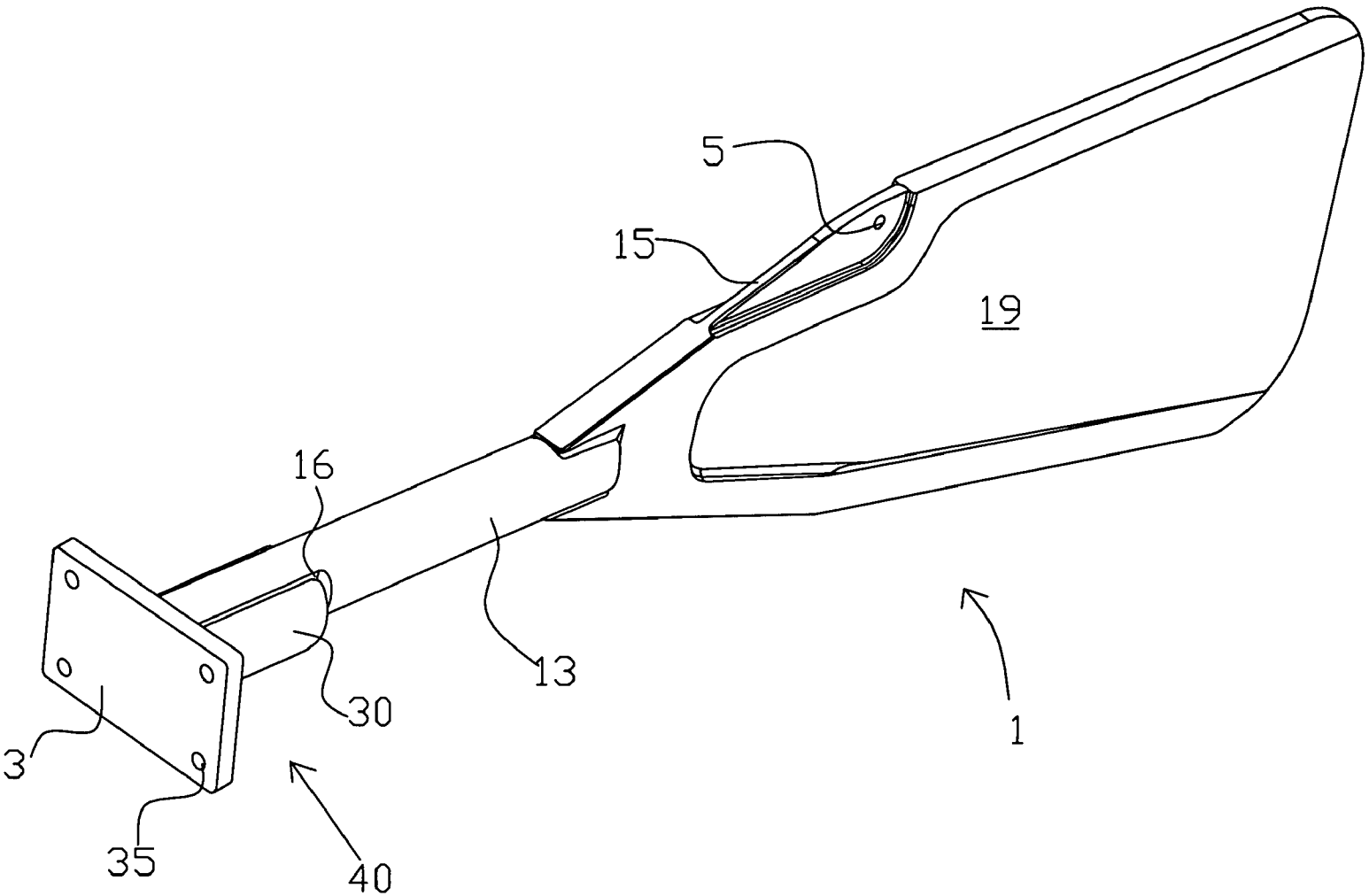
FIG. 1 is a perspective view of the stabilizing device.

FIG. 1 is a perspective view of the watercraft stabilizing device 1 of the present invention. The device 1 comprises a mounting device that includes a mounting plate 3 that includes a plurality of mounting holes 35 for passing fasteners such as screws therethrough to fasten the device to a watercraft, preferably a hull of a boat. Trough 30 is integrally formed with the mounting plate 3 in a downward fashion as more clearly shown in FIG. 2A and 2B.

A first end of handle 13 rests in trough 30. Preferably, handle 13 is generally cylindrical in shape with a cut-out regions 16 more clearly shown in FIG. 3A. Integrally formed at an opposite end of handle 13 is blade 19 more clearly shown in FIGS. 3A and 3B. A thin grip 15 includes a hole 5 for securing the device in an upward position. An end of a line having a fastening device, knot or the like passes through hole 5 and is secured at an opposite end to the watercraft.

Figure 2B:
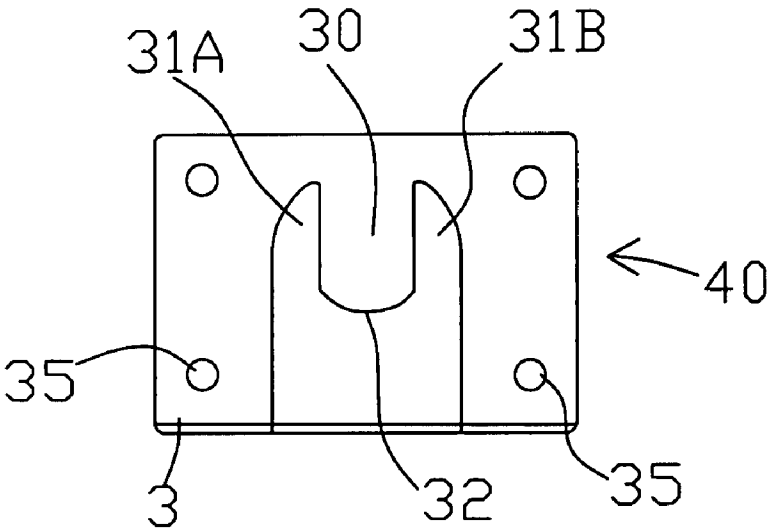
FIG. 2B is an elevation front view of the support device shown in FIG. 2A.
Figure 2A:
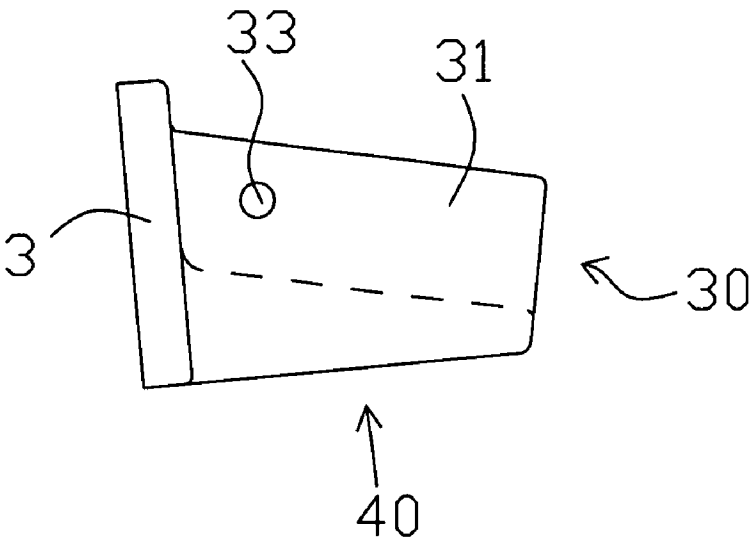
FIG. 2A is an elevation, side view of the support device that secures the stabilizing device to a watercraft.

FIGS. 2A and 2B show the mounting device 40 that comprises mounting plate 3 and trough 30. Trough 30 comprises sides 31A and 31B which include holes 33 for passing a pivot pin 50 therethrough to secure handle 13 to mounting device 40. Trough 30 comprises sides 31A, 31B and bottom 32. As represented by the broken line shown in FIG. 2A, trough 30 slopes downward as it extends away from mounting plate 3. Bottom 32 is rounded for accommodating the rounded portion of the handle 13.

Figure 3A:
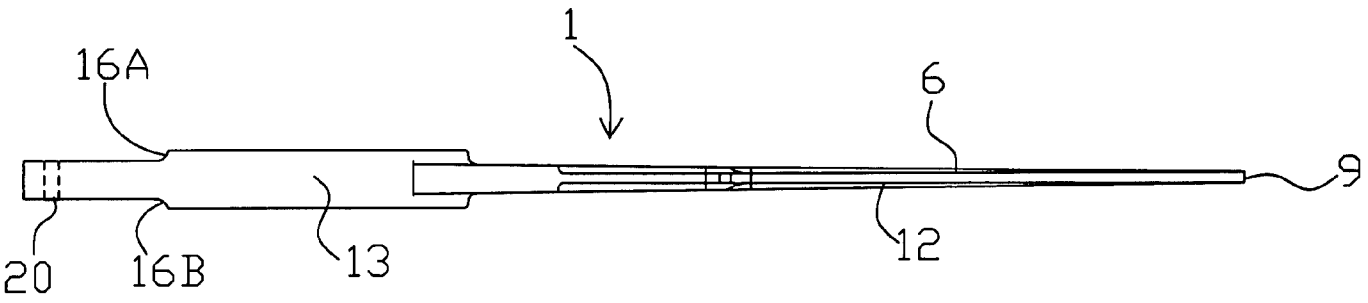
FIG. 3A is a top view of the combination handle and blade portion of the stabilizing device.
Figure 3B:
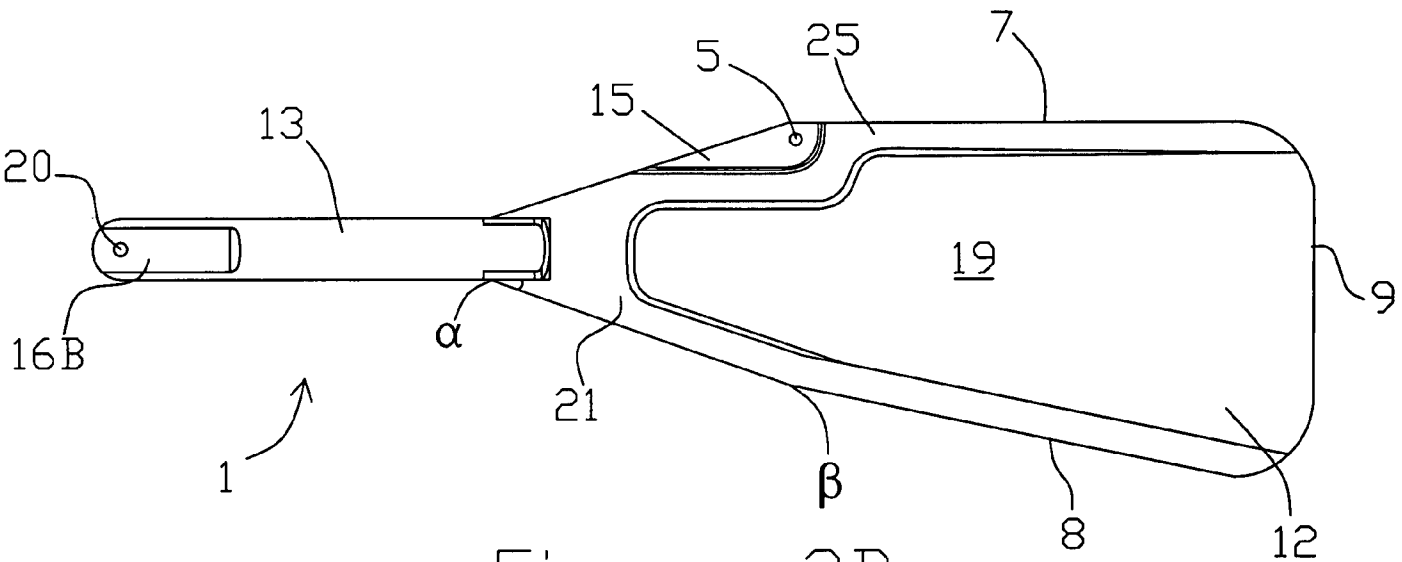
FIG. 3B is an elevation side view of FIG. 3A.

FIGS. 3A and 3B show the handle 13 and blade 19. Handle 13 is generally cylindrical in shape and includes two cutout portions 16A, 16B which securely fasten the handle 13 to the trough 30. Hole 20 is provided for passing a pivot pin 50 therethrough. Blade 19 comprises stabilizing surfaces 6 and 12, end 9, upper surface 7 and lower surface 8. Lower surface 8 includes a first angle a preferably 19 degrees and a second angle β preferably 12 degrees. The angles are formed in a stepwise fashion as shown. Upper and lower edges 7, 8 include a reinforced portion 25 as shown. The reinforced portion 25 helps to ensure that the blade 19 does not easily break when encountering a submerged object.

Figure 4:
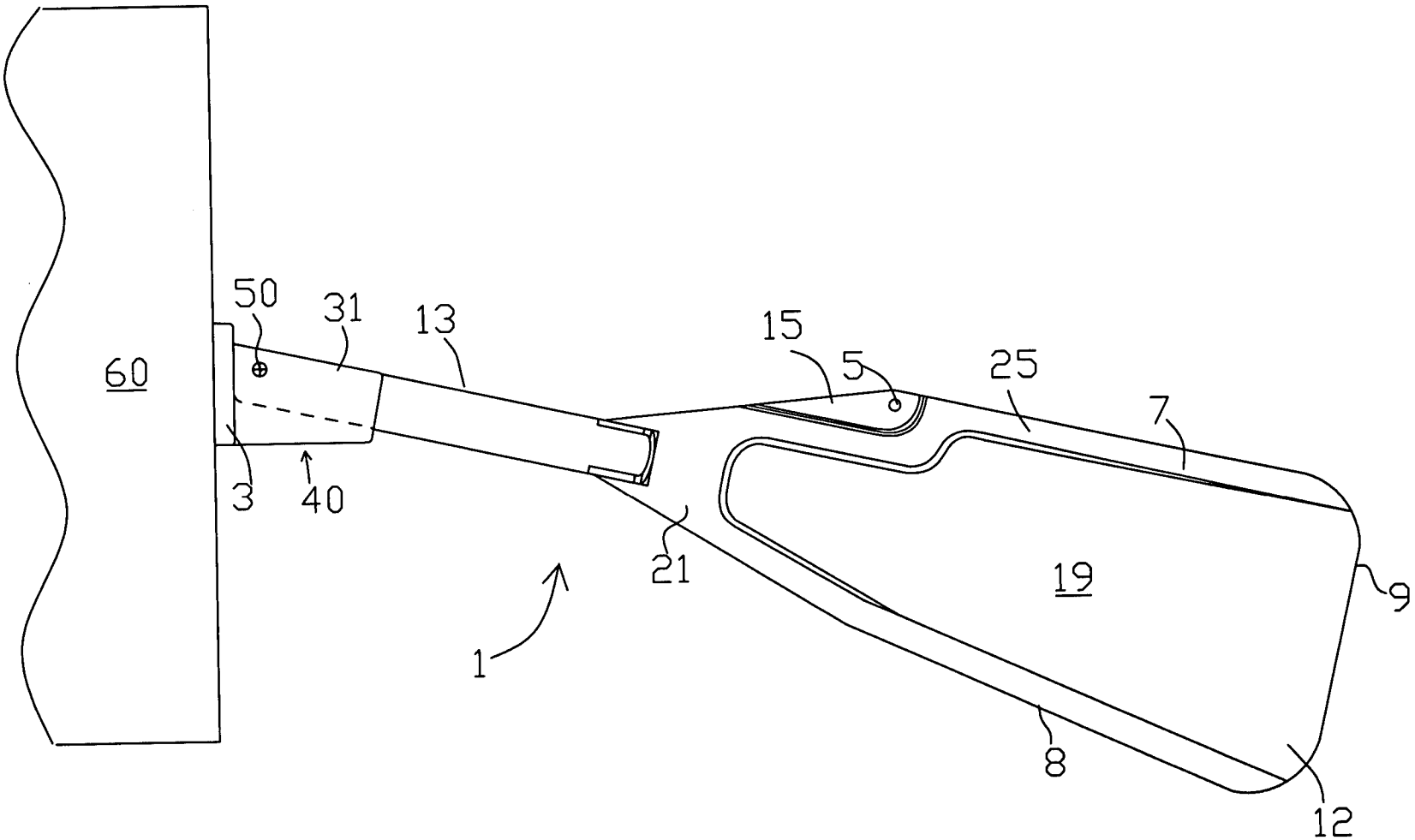
FIG. 4 is a side view of the device mounted on a watercraft.
Figure 5:
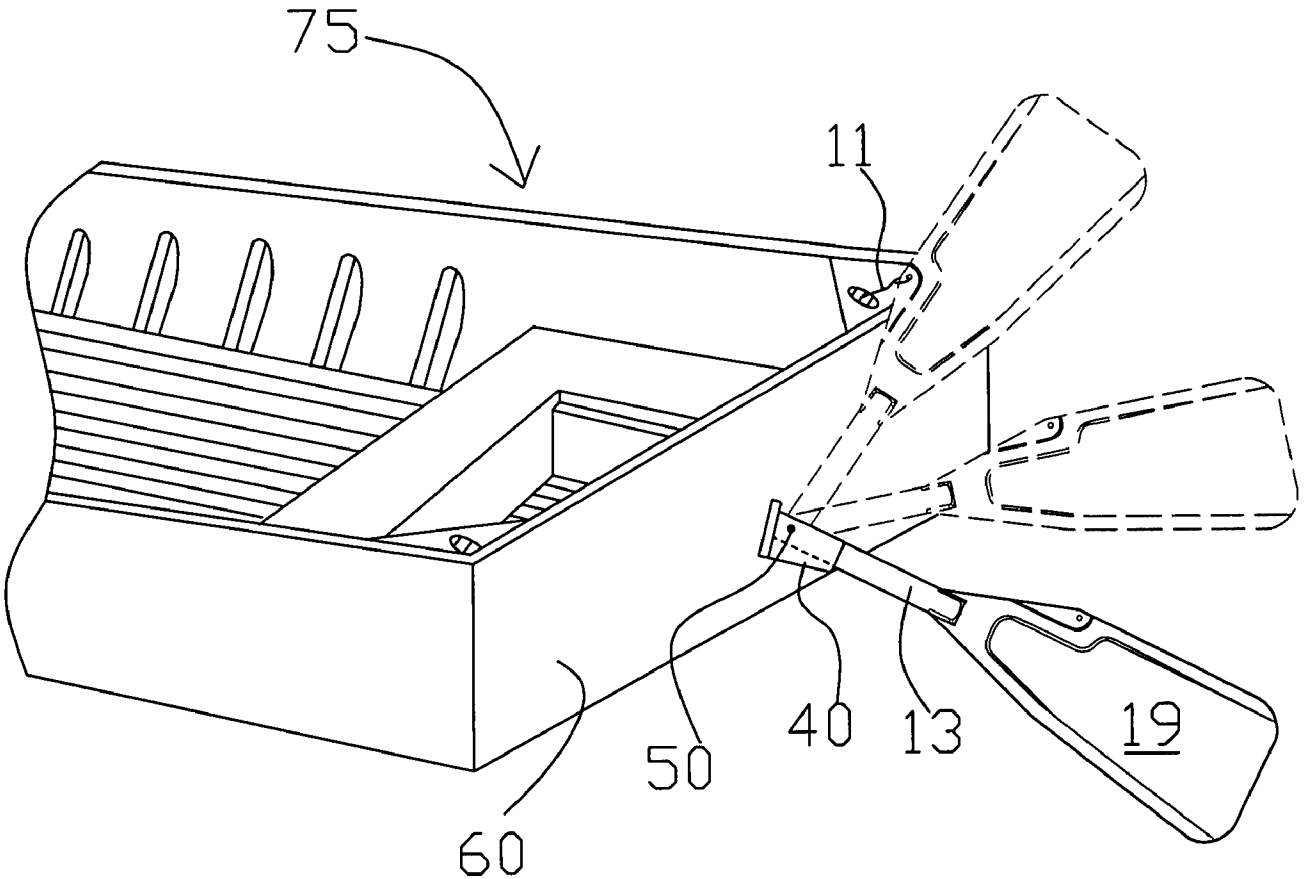
FIG. 5 is a perspective view of the stabilizing device in various positions.

FIGS. 4 and 5 show the stabilizing device mounted onto a hull 60 of a boat 75. The downward angle of the trough 30 and the extended downward angles provided on the lower surface 8 extend the stabilizing surface of the device to assure great stabilizing of the boat to which it attaches. As shown in FIG. 5, the device 1 rotates in a vertical manner when encountering a submerged object. Alternatively, the device can be easily raised and secured in an upward fashion via line 11.

I claim:

1. A watercraft stabilizing device comprising:

a support device comprising a mounting bracket having a flat base and holes therein for securing the support base to a hull of a water craft via fastening means, a trough formed integral to said flat base includes a bottom and two sides, each side having a hole therein for receiving a pin, said trough extending downward away from the mounting bracket;

a blade having an upper and lower edge and two planar sides, said lower edge having two downward angles arranged in a step-wise manner such that the lower edge extends downward, and a shaft connected at one end to the blade and having a hole near an end opposite the blade, such that said end near the hole is arranged in the trough and said hole is aligned with the holes in the sides of the trough; and, a pin passing through said holes in the sides of the trough and the hole in the handle.

2. The watercraft stabilizing device of claim 1 wherein a length of the trough is 10% greater than an overall combined length of the blade and shaft.

3. The watercraft stabilizing device of claim 1 wherein the blade is narrower in width in a direction from an end proximal to the support device and running in the direction of a distal end.

4. The watercraft stabilizing device of claim 1 wherein the blade comprises a top edge and a bottom edge widened vertically from the shaft while the bottom edge includes a first angle and a second angle connecting to large radiuses on the ends of top and bottom edges.

5. The watercraft stabilizing device of claim 1 wherein the blade becomes narrower along a longitudinal axis running from an end proximal to the support device towards a distal end.

6. The watercraft stabilizing device of claim 1 wherein the blade reduces in thickness at a distal end such that it is approximately ⅓ of a thickness at a point where the blade meets the shaft.

7. The watercraft stabilizing device of claim 1 wherein said the top edge rises at an angle of 17 degrees from the shaft for ⅓ of the length of the blade portion, and thereafter runs parallel to a horizontal axis extending through a center of the shaft.

8. The watercraft stabilizing device of claim 1 wherein said bottom edge extends at an angle of 19 degrees relative to a central axis of the shaft for ⅓ of the length of the blade portion, and thereafter at an angle of 12 additional degrees relative to the central axis of the shaft.

9. The watercraft of claim 1 wherein said blade further comprises a hole arranged in the top edge of the blade to allow connection of a line from the top edge of the blade portion of the device to a watercraft to which the stabilizing device is mounted.

10. The watercraft of claim 1 wherein the shaft is generally 25–40% of an overall length of the combined blade and shaft.

11. The watercraft of claim 1 wherein a downward angle of the trough relative to the mounting plate is between 100 and 110 degrees.

12. The watercraft of claim 1 wherein a downward angle of the trough relative to the mounting plate is 102 degrees.

13. A watercraft stabilizing device comprising:

a support device comprising a mounting bracket having a flat base and holes therein for securing the support base to a hull of a water craft via fastening means, a trough formed integral to said flat base includes a bottom and two sides, each side having a hole therein for receiving a pin, said trough extending downward away from the mounting bracket;

a blade having an upper and lower edge and two planar sides, said lower edge having two downward angles arranged in a step-wise manner such that the lower edge extends downward; and a shaft connected at one end to a blade and having a hole near an end opposite the blade, such that said end near the hole is arranged in the trough and said hole is aligned with the holes in the sides of the trough; and, a pin passing through said holes in the sides of the trough and the hole in the handle, wherein a length of the trough is 10% than an overall combined length of the blade and shaft, wherein the blade is narrower in width in a direction from an end proximal to the support device and running in the direction of a distal end, and wherein the blade becomes narrower along a longitudinal axis running from an end proximal to the support device towards a distal end.

14. The watercraft stabilizing device of claim 13 wherein the blade reduces in thickness at a distal end such that it is approximately ⅓ of a thickness at a point where the blade meets the shaft.

15. The watercraft stabilizing device of claim 13 wherein said the top edge rises at an angle of 17 degrees from the shaft for ⅓ of the length of the blade portion, and thereafter runs parallel to a horizontal axis extending through a center of the shaft.

16. The watercraft stabilizing device of claim 13 wherein said bottom edge extends at an angle of 19 degrees relative to a central axis of the shaft for ⅓ of the length of the blade portion, and thereafter at an angle of 12 additional degrees relative to the central axis of the shaft.

17. The watercraft of claim 13 wherein said blade further comprises a hole arranged in the top edge of the blade to allow connection of a line from the top edge of the blade portion of the device to a watercraft to which the stabilizing device is mounted.

18. The watercraft of claim 13 wherein the shaft is generally 25–40% of an overall length of the combined blade and shaft.

* * * * *